US011469036B2

(12) United States Patent
Park

(10) Patent No.: US 11,469,036 B2
(45) Date of Patent: Oct. 11, 2022

(54) INDUCTOR

(71) Applicant: SAMSUNG ELECTRO-MECHANICS CO., LTD., Suwon-si (KR)

(72) Inventor: Jong Ik Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 136 days.

(21) Appl. No.: 16/925,788

(22) Filed: Jul. 10, 2020

(65) Prior Publication Data

US 2020/0343038 A1 Oct. 29, 2020

Related U.S. Application Data

(63) Continuation of application No. 15/002,132, filed on Jan. 20, 2016, now Pat. No. 10,734,157.

(30) Foreign Application Priority Data

Apr. 29, 2015 (KR) ..... 10-2015-0060289

(51) Int. Cl.

| | |
|---|---|
| ***H01F 5/00*** | (2006.01) |
| ***H01F 27/29*** | (2006.01) |
| ***H01F 17/04*** | (2006.01) |
| ***H01F 17/00*** | (2006.01) |

(52) U.S. Cl.

CPC ..... *H01F 27/292* (2013.01); *H01F 17/0013* (2013.01); *H01F 17/04* (2013.01); *H01F 2017/048* (2013.01)

(58) Field of Classification Search

CPC .... H01F 27/292; H01F 17/0013; H01F 17/04; H01F 2017/048

USPC ..... 336/200

See application file for complete search history.

(56) References Cited

U.S. PATENT DOCUMENTS

| | | | |
|---|---|---|---|
| 3,590,480 | A | 7/1971 | Johnson |
| 4,217,689 | A | 8/1980 | Fujii |
| 4,610,079 | A | 9/1986 | Abe |
| 4,814,296 | A | 3/1989 | Jedlicka |
| 4,853,815 | A | 8/1989 | Diepers |

(Continued)

FOREIGN PATENT DOCUMENTS

| | | | | |
|---|---|---|---|---|
| CN | 111799059 A | * | 10/2020 | ..... H01F 27/24 |
| JP | 2001-266431 A | | 9/2001 | |

(Continued)

OTHER PUBLICATIONS

Office Action issued in corresponding Korean Patent Application No. 10-2015-0060289 dated Oct. 30, 2019 (with English translation).

(Continued)

*Primary Examiner* — Elvin G Enad
*Assistant Examiner* — Joselito S. Baisa
(74) *Attorney, Agent, or Firm* — Morgan, Lewis & Bockius LLP

(57) ABSTRACT

An inductor includes a magnetic body including a magnetic substance; a substrate disposed within the magnetic body; and an internal electrode disposed on at least one of an upper surface and a lower surface of the substrate. The substrate is disposed on an inclined with respect to at least one surface of the magnetic body.

7 Claims, 5 Drawing Sheets

(56) References Cited

U.S. PATENT DOCUMENTS

| | | | | |
|---|---|---|---|---|
| 4,860,433 | A | 8/1989 | Miura | |
| 5,022,141 | A | 6/1991 | Nagata | |
| 5,157,576 | A | 10/1992 | Takaya | |
| 5,189,949 | A | 3/1993 | Apa | |
| 5,245,493 | A | 9/1993 | Kawabe | |
| 5,805,391 | A | 9/1998 | Chang | |
| 6,055,976 | A | 5/2000 | Davies | |
| 6,191,468 | B1 * | 2/2001 | Forbes | H01F 17/0013 257/528 |
| 6,296,776 | B1 | 10/2001 | Sasaki | |
| 6,504,463 | B1 | 1/2003 | Kato | |
| 7,190,553 | B2 | 3/2007 | Morita | |
| 7,304,557 | B2 | 12/2007 | Tsuzuki | |
| 7,446,638 | B2 | 11/2008 | Nogi | |
| 7,989,320 | B2 | 8/2011 | Boyle | |
| 8,975,997 | B2 | 3/2015 | Tonoyama | |
| 9,559,028 | B2 * | 1/2017 | Takeda | H01L 23/13 |
| 9,966,498 | B2 | 5/2018 | Tsai | |
| 10,049,808 | B2 * | 8/2018 | Ahn | H01F 27/29 |
| 10,878,986 | B1 * | 12/2020 | Satou | H01F 27/255 |
| 2002/0158547 | A1 | 10/2002 | Wood | |
| 2003/0025085 | A1 | 2/2003 | Nakano | |
| 2006/0152321 | A1 | 7/2006 | Jung | |
| 2006/0214759 | A1 | 9/2006 | Kawarai | |
| 2007/0146109 | A1 | 6/2007 | Nogi | |
| 2007/0182519 | A1 | 8/2007 | Tsuzuki | |
| 2008/0055859 | A1 | 3/2008 | Furukawa | |
| 2009/0067110 | A1 | 3/2009 | Beyer | |
| 2010/0271163 | A1 | 10/2010 | Nakamura | |
| 2011/0069363 | A1 | 3/2011 | Chikaoka | |
| 2011/0158276 | A1 | 6/2011 | Takagi | |
| 2012/0012632 | A1 | 1/2012 | Tominaga | |
| 2012/0032307 | A1 | 2/2012 | Tomita | |
| 2013/0249662 | A1 * | 9/2013 | To | H01F 17/0013 336/200 |
| 2014/0167897 | A1 | 6/2014 | Choi et al. | |
| 2014/0176283 | A1 | 6/2014 | Yang | |
| 2015/0102891 | A1 * | 4/2015 | Yoon | H01F 27/2804 336/200 |
| 2016/0042997 | A1 | 2/2016 | Takahashi | |
| 2016/0217909 | A1 * | 7/2016 | Park | H01F 17/04 |
| 2017/0150606 | A1 * | 5/2017 | Yoon | H01F 17/0033 |
| 2020/0219644 | A1 * | 7/2020 | Kim | H01F 27/2804 |
| 2020/0321156 | A1 * | 10/2020 | Morita | H01F 27/24 |

FOREIGN PATENT DOCUMENTS

| | | | |
|---|---|---|---|
| JP | 2004-342814 | A | 12/2004 |
| JP | 2007-157983 | A | 6/2007 |
| JP | 2009-49046 | A | 3/2009 |
| KR | 10-2006-0061709 | A | 6/2006 |
| KR | 10-2006-0081493 | A | 7/2006 |
| KR | 10-2014-0077346 | A | 6/2014 |

OTHER PUBLICATIONS

Non-Final Office Action issued in U.S. Appl. No. 15/002,132, dated Jul. 10, 2019.

Non-Final Office Action issued in U.S. Appl. No. 15/002,132, dated Jun. 1, 2018.

Non-Final Office Action issued in U.S. Appl. No. 15/002,132, dated Jun. 20, 2017.

Final Office Action issued in U.S. Appl. No. 15/002,132, dated Jan. 2, 2020.

Final Office Action issued in U.S. Appl. No. 15/002,132, dated Feb. 4, 2019.

Final Office Action issued in U.S. Appl. No. 15/002,132, dated Jan. 11, 2018.

Notice of Allowance issued in U.S. Appl. No. 15/002,132, dated Apr. 1, 2020.

* cited by examiner

INDUCTOR

CROSS-REFERENCE TO RELATED APPLICATION

This application is a continuation of U.S. patent application Ser. No. 15/002,132, filed on Jan. 20, 2016 which claims the benefit of priority to Korean Patent Application No. 10-2015-0060289, filed on Apr. 29, 2015 with the Korean Intellectual Property Office, the disclosures of each are incorporated herein by reference in their entirety.

TECHNICAL FIELD

The present inventive concept relates to an inductor.

BACKGROUND

An inductor, together with a resistor and a capacitor, is a key passive element constituting an electronic circuit. Inductors are used in components to cancel noise or to form an LC resonance circuit. Inductors may be classified as winding type inductors, laminated type inductors, thin film type inductors, and the like, according to the structure thereof.

A winding type inductor may be formed by winding a coil around a ferrite core. A winding type inductor may have stray capacitance generated between coil portions, and accordingly, when the number of turns of a coil is increased to obtain high capacity inductance, degradation of high frequency characteristics may occur.

A laminated type inductor may be formed by laminating a plurality of ceramic sheets. In a laminated type inductor, coil-like metal patterns are formed on respective ceramic sheets, and the coil-like metal patterns may be sequentially connected to one another by a plurality of conductive vias provided in the ceramic sheets. Laminated type inductors are appropriate for mass-production, and have excellent high frequency characteristics compared to winding type inductors.

However, in a laminated type inductor, metal patterns are formed of a material having a low saturation magnetization value. When a laminated type inductor is manufactured to have a small size, the number of laminations of the metal patterns is limited, and this may lead to a degradation in DC superposition characteristics, thereby resulting in a failure to obtain a sufficient current.

A thin film type inductor may use a material having a high saturation magnetization value, and even when a thin film type inductor is manufactured to have a small size, an internal circuit pattern thereof may be easily formed in comparison to a laminated type inductor. Thus, research has been actively undertaken into thin film type inductors.

When a thin film type inductor is manufactured on a large scale, a line width or thickness of a coil may be increased, thereby eliminating degradation in product characteristics due to an increase in series resistance.

However, when a thin film type inductor is manufactured to have a small size, an increase in the line width or thickness of a coil is limited. Thus, delamination, cracks, and the like may occur between internal electrodes formed within the inductor and a substrate, and between magnetic substances of an inductor body during a chip-cutting process.

SUMMARY

An aspect of the present inventive concept provides an inductor having high capacity characteristics and allowing for reliability improvements in a manufacturing process by preventing defects due to delamination, cracks, and the like.

According to an aspect of the present inventive concept, an inductor includes: a magnetic body including a magnetic substance; a substrate disposed within the magnetic body; and an internal electrode disposed on at least one of an upper surface and a lower surface of the substrate, the substrate being disposed on an inclined with respect to at least one surface of the magnetic body.

In addition, a minimum distance of the distances from the upper and lower surfaces of the magnetic body to the portion thereof to which the substrate is exposed may be 60 μm or more.

In addition, when the internal electrode is disposed on the upper surface or the lower surface of the substrate to be exposed to one end surface of the magnetic body, a distance from the upper surface of the magnetic body to a portion of the end surface to which the internal electrode is exposed may be 100 μm or more, and a distance from the lower surface of the magnetic body to a portion of the end surface to which the internal electrode is exposed may be 150 μm or more.

BRIEF DESCRIPTION OF THE DRAWINGS

The above and other aspects, features, and advantages of the present inventive concept will be more clearly understood from the following detailed description taken in conjunction with the accompanying drawings, in which.

DETAILED DESCRIPTION OF EMBODIMENTS

Figure 1:
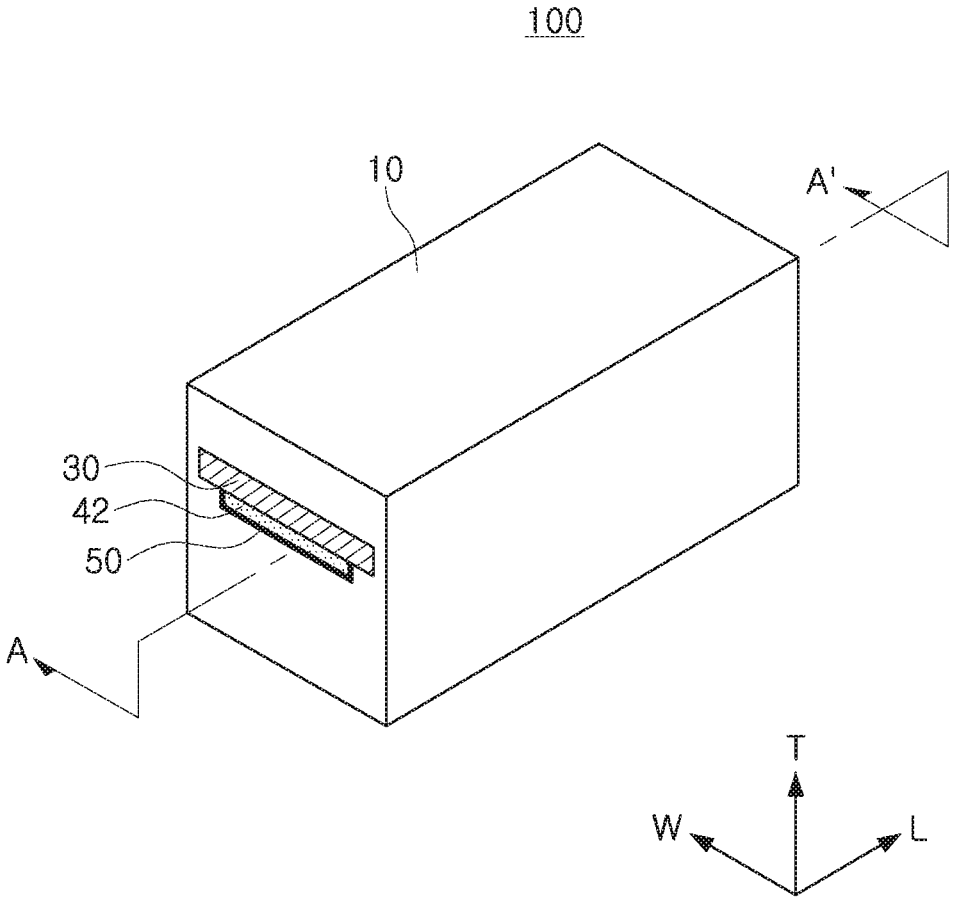
FIG. 1 is a perspective view of an inductor according to an embodiment of the present inventive concept.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "upper," or "above" other elements would then be oriented "lower," or "below" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise.

It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a configuration herein, but are not limited thereto.

Figure 2:
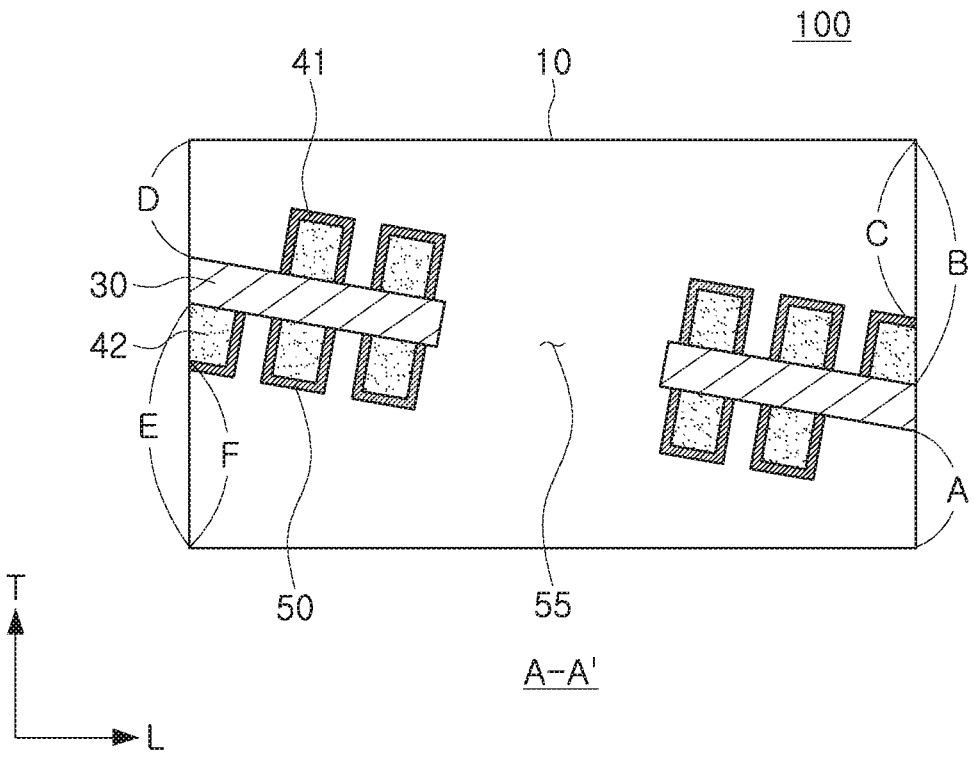
FIG. 2 is a cross-sectional view of the inductor illustrated in FIG. 1, taken along line A-A'.

FIG. 1 is a perspective view of an inductor 100 according to an embodiment of the present inventive concept. FIG. 2 is a cross-sectional view of the inductor 100 illustrated in FIG. 1, taken along line A-A'.

As shown in FIGS. 1 and 2, a thickness direction of a magnetic body 10 is referred to as "T", a length direction thereof is referred to as "L", and a width direction thereof is referred to as "W". Surfaces facing an upper surface and a lower surface of a substrate 30 disposed inside a magnetic body 10 are defined as an upper surface and a lower surface of the magnetic body 10, respectively. Surfaces through which the substrate 30 is exposed outwardly from the magnetic body 10 are defined as first and second end surfaces of the magnetic body 10, and surfaces adjacent to the first and second end surfaces in the length or width direction are defined as third and fourth side surfaces. In this case, the upper surface and the lower 10 surface of the magnetic body 10 are adjacent to the first and second end surfaces in the thickness direction.

Referring to FIGS. 1 and 2, the inductor 100 according to an exemplary embodiment of the present inventive concept may include the magnetic body 10 including a magnetic substance, the substrate 30 disposed within the magnetic body 10, and internal electrodes 41 and 42 disposed on at least one of the upper surface and the lower surface of the substrate 30, the substrate 30 being disposed on an incline with respect to at least one surface of the magnetic body 10.

In general, an inductor-manufacturing process may be subjected to a process of cutting a magnetic body (hereinafter referred to as a "bulk magnetic body") for manufacturing a plurality of inductors into individual inductor units. In this case, defects such as cracks, delamination, and the like may occur in the magnetic body mainly from cut surfaces of the magnetic body, due to differences in physical properties among the internal electrodes, the substrate, and the magnetic substance.

In particular, when distances from the upper surface and the lower surface of the magnetic body to the internal electrodes and the substrate are insufficiently secured in order to miniaturize the inductor, the possibility of incurring defects among the internal electrodes, the substrate, and the magnetic body due to stress resulting from the cutting process applied to the magnetic body may be increased.

When distances from the upper surface and the lower surface of the magnetic body to the internal electrodes and the substrate are increased in order to prevent defects such as cracks, delamination, and the like, miniaturization of the inductor may not be feasible. When an area occupied by the internal electrodes is reduced, the capacity of the inductor may be decreased.

In the inductor 100 according to an exemplary embodiment of the present inventive concept, the substrate 30 on which the internal electrodes 41 and 42 are disposed may be disposed on an incline, and thus a size of the magnetic body 10 may be maintained, and distances between the internal electrodes 41 and 42 and the upper surface and the lower surface of the magnetic body 10 may be increased, thereby preventing the occurrence of cracks, delamination, and the like during a cutting process.

In addition, a length of the substrate 30 disposed within the magnetic body 10 may be increased, and thus the area occupied by the internal electrodes 41 and 42 may be increased, thereby increasing the capacity of the inductor 100.

Referring to FIGS. 1 and 2, the substrate 30 disposed within the magnetic body 10 may be exposed to at least one external surface of the magnetic body 10. On the surface of the magnetic body 10 to which the substrate 30 is exposed, a distance from the upper surface of the magnetic body 10 to a portion thereof to which the substrate 30 is exposed may be different from a distance from the lower surface of the magnetic body 10 to the portion thereof to which the substrate 30 is exposed.

In this case, it may be advantageous to dispose the substrate away from the upper surface and the lower surface of the magnetic body in order to prevent cracks from occurring in the vicinity of the substrate positioned on a cut surface of the magnetic body due to stress caused when the bulk magnetic body is cut into respective units. In an exemplary embodiment of the present inventive concept, a minimum distance of the distances from the upper and lower surfaces of the magnetic body 10 to the portion thereof to which the substrate 30 is exposed may be set to 60 μm or more.

In particular, in the case of the inductor 100 in which a thickness thereof, that is, a distance from the upper surface to the lower surface of the magnetic body 10, is 0.8 mm or less, a minimum distance of the distances from the upper and lower surfaces of the magnetic body 10 to the portion thereof to which the substrate 30 is exposed may preferably be set to 60 μm or more, in order to prevent defects during a cutting process.

In addition, when the substrate 30 is exposed to the first end surface and the second end surface of the magnetic body 10, a distance from the lower surface of the magnetic body 10 to a portion of the first end surface to which the substrate 30 is exposed may be different from a distance from the lower surface of the magnetic body 10 to a portion of the second end surface to which the substrate 30 is exposed. In this case, a minimum distance of the distances from the upper and lower surfaces of the magnetic body 10 to the portions thereof to which the substrate 30 is exposed may be set to 60 μm or more.

Referring to FIGS. 1 and 2, the internal electrode 41 or 42 formed within the magnetic body 10 may be disposed on the upper surface or the lower surface of the substrate 30 to be exposed to one end surface of the magnetic body 10. When the internal electrode 41 or 42 is disposed on the upper surface of the substrate 30 to be exposed to one end surface of the magnetic body 10, a distance from the upper surface of the magnetic body 10 to a portion of the end surface to which the internal electrode 41 or 42 is exposed may preferably be set to 100 μm or more. When the internal electrode 41 or 42 is disposed on the lower surface of the substrate 30 to be exposed to one end surface of the magnetic body 10, a distance from the lower surface of the magnetic body 10 to a portion of the end surface to which the internal electrode 41 or 42 is exposed may preferably be set to 150 μm or more.

Cutting stress occurring when a bulk magnetic body is cut into individual inductor units due to differences in physical properties among the internal electrodes, the substrate, and the magnetic substance filling the magnetic body 10 may more significantly act on spaces between the internal electrodes and the magnetic body, rather than on spaces between the substrate 30 and the magnetic substance. Therefore, distances from the upper and lower surfaces of the magnetic body 10 to the internal electrodes 41 and 42 may preferably be greater than distances from the upper and lower surfaces of the magnetic body 10 to the substrate 30.

As described above, a distance from the upper surface of the magnetic body 10 to a portion of the end surface to which the internal electrode 41 is exposed may preferably be set to 100 μm or more, and a distance from the lower surface of the magnetic body 10 to a portion of the end surface to which the internal electrode 42 is exposed may preferably be set to 150 20 μm or more. In particular, in the case of the inductor 100 in which a thickness thereof, that is, a distance from the upper surface to the lower surface of the magnetic body 10, is 0.8 mm or less, a distance from the upper surface of the magnetic body 10 to a portion of the end surface to which the internal electrode 41 is exposed may preferably be set to 100 μm or more, and a distance from the lower surface of the magnetic body 10 to a portion of the end surface to which the internal electrode 42 is exposed may preferably be set to 150 μm or more, in order to prevent defects during a cutting process.

In addition, the substrate 30 may be exposed to the first end surface and the second end surface of the magnetic body 10, and the internal electrodes 41 and 42 may include a first internal electrode 41 exposed to the first end surface of the magnetic body 10 and a second internal electrode 42 exposed to the second end surface of the magnetic body 10. When each of the first and second internal electrodes 41 and 42 is disposed on the upper surface or the lower surface of the substrate 30 to be exposed, distances between the first and second internal electrodes 41 and 42 and the upper and lower surfaces of the magnetic body 10 may be set as below.

When the first internal electrode 41 is disposed on the upper surface of the substrate 30 to be exposed to the first end surface of the magnetic body 10, a distance from the upper surface of the magnetic body 10 to a portion of the end surface to which the first internal electrode 41 is exposed may be set to 100 μm or more. When the first internal electrode 41 is disposed on the lower surface of the substrate 30 to be exposed to the first end surface of the magnetic body 10, a distance from the lower surface of the magnetic body 10 to a portion of the end surface to which the first internal electrode 41 is exposed may be set to 150 μm or more. When the second internal electrode 42 is disposed on the upper surface of the substrate 30 to be exposed to the second end surface of the magnetic body 10, a distance from the upper surface of the magnetic body 10 to a portion of the end surface to which the second internal electrode 42 is exposed may be set to 100 μm or more. When the second internal electrode 42 is disposed on the lower surface of the substrate 30 to be exposed to the second end surface of the magnetic body 10, a distance from the lower surface of the magnetic body 10 to a portion of the end surface to which the second internal electrode 42 is exposed may be set to 150 μm or more.

That is, the internal electrode 41 or 42 is exposed outwardly from the magnetic body 110 while being disposed on the upper surface or the lower surface of the substrate 30. When the internal electrode 41 is disposed on the upper surface of the substrate 30 to be exposed outwardly from the magnetic body 110, the internal electrode 41 may be spaced apart from the upper surface of the magnetic body 110 by 100 μm or more. When the internal electrode 42 is disposed on the lower surface of the substrate 30 to be exposed outwardly from the magnetic body 110, the internal electrode 42 may be spaced apart from the lower surface of the magnetic body 110 by 150 μm or more.

Hereinafter, on the basis of FIG. 2, the inductor 100 according to the exemplary embodiment of the present inventive concept will be described in detail.

In FIG. 2, the substrate 30 may be exposed to the first end surface and the second end surface of the magnetic body 10, and a distance A from the lower surface of the magnetic body 10 to a portion of the second end surface thereof to which the substrate 30 is exposed may be shorter than a distance E from the lower surface of the magnetic body 10 to a portion of the first end surface thereof to which the substrate 30 is exposed.

In addition, a distance B from the upper surface of the magnetic body 10 to a portion of the second end surface thereof to which the substrate 30 is exposed may be greater than a distance D from the upper surface of the magnetic body 10 to a portion of the first end surface thereof to which the substrate 30 is exposed.

The internal electrodes 41 and 42 may include the first internal electrode 41 disposed on the upper surface of the substrate 30 to be exposed to the second end surface of the magnetic body 10 and the second internal electrode 42 disposed on the lower surface of the substrate to be exposed to the first end surface of the magnetic body 10.

In this case, the distance A from the lower surface of the magnetic body 10 to a portion of the second end surface thereof to which the substrate 30 is exposed, and the distance D from the upper surface of the magnetic body 10 to a portion of the first end surface thereof to which the substrate 30 is exposed, may be respectively set to 60 μm or more.

In addition, a distance C from the upper surface of the magnetic body 10 to a portion of the second end surface thereof to which the first internal electrode 41 is exposed may be set to 100 μm or more, and a distance F from the lower surface of the magnetic body 10 to a portion of the first end surface thereof to which the second internal electrode 42 is exposed may be respectively set to 150 μm or more.

Through such a configuration, defects during a cutting process may be prevented, and high capacity may be formed as described above.

Figure 3:
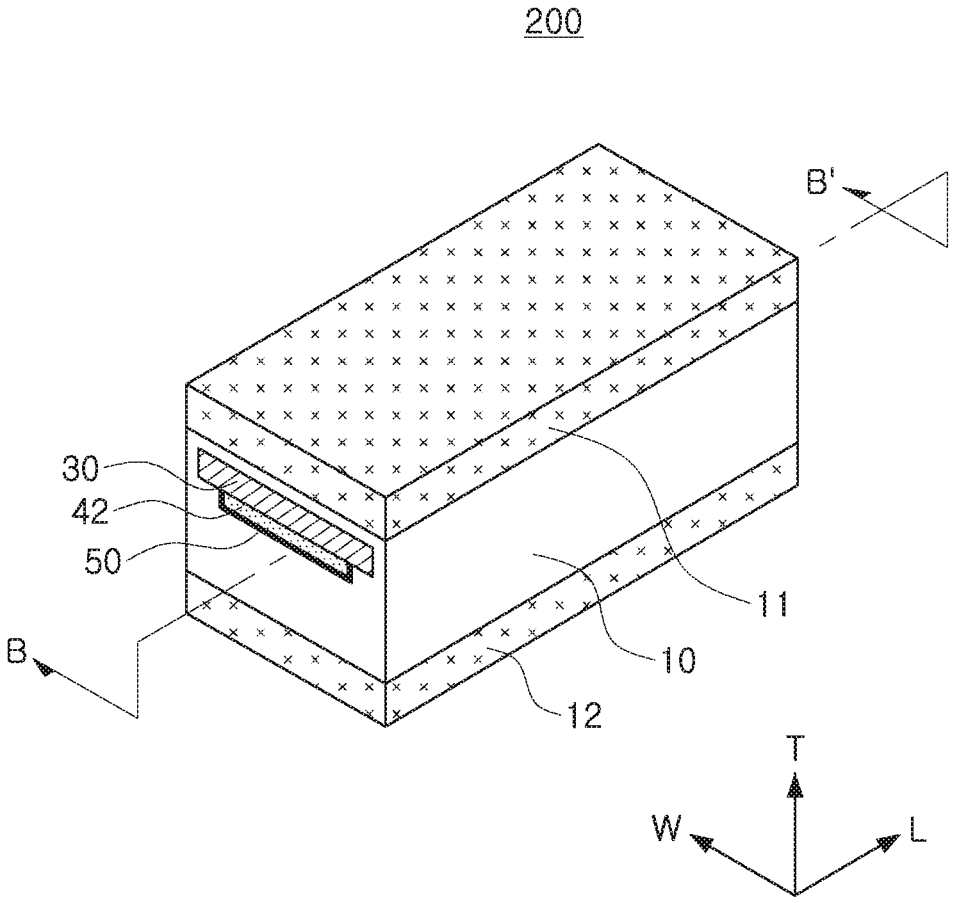
FIG. 3 is a perspective view of an inductor according to another embodiment of the present inventive concept.
Figure 4:
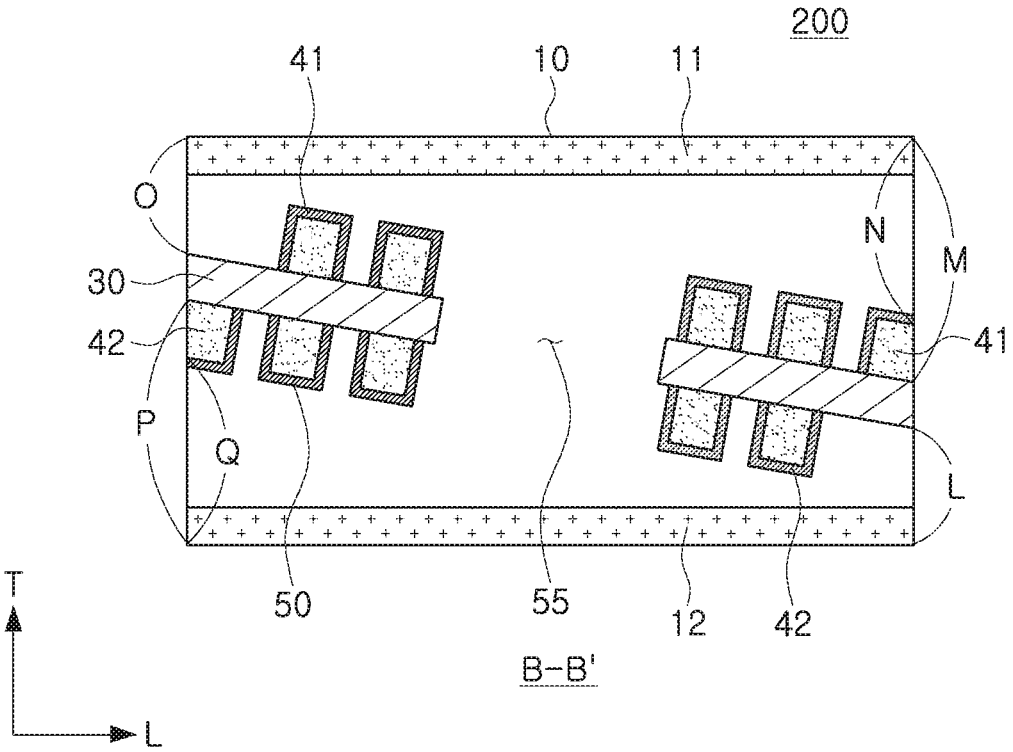
FIG. 4 is a cross-sectional view of the inductor illustrated in FIG. 3, taken along line B-B'.

FIG. 3 is a perspective view of an inductor 200 according to another embodiment of the present inventive concept, and FIG. 10 4 is a cross-sectional view of the inductor 200 illustrated in FIG. 3, taken along line B-B'.

Referring to FIGS. 3 and 4, the magnetic body 10 may further include an upper cover layer 11 and a lower cover layer 12 disposed, respectively, above and below the substrate 30 and the internal electrodes 41 and 42. The upper cover layer 11 and the lower cover layer 12 may serve to prevent degradation in electrical characteristics of the first and second internal electrodes 41 and 42.

In FIGS. 3 and 4, the substrate 30 may be exposed to the first and second end surfaces of the magnetic body 10, and a distance L from the lower surface of the magnetic body 10 to a portion of the first end surface thereof to which the substrate 30 is exposed may be shorter than a distance P from the lower surface of the magnetic body 10 to a portion of the second end surface thereof to which the substrate 30 is exposed.

In addition, a distance M from the upper surface of the magnetic body 10 to a portion of the first end surface thereof to which the substrate 30 is exposed may be greater than a distance 0 from the upper surface of the magnetic body 10 to a portion of the second end surface thereof to which the substrate 30 is exposed.

The internal electrodes 41 and 42 may include the first internal electrode 41 disposed on the upper surface of the substrate 30 to be exposed to the first end surface of the magnetic body 10 and the second internal electrode 42 disposed on the lower surface of the substrate 30 to be exposed to the second end surface of the magnetic body 10.

In this case, the distance L from the lower surface of the magnetic body 10 to a portion of the first end surface thereof to which the substrate 30 is exposed and the distance 0 from the upper surface of the magnetic body 10 to a portion of the second end surface thereof to which the substrate 30 is exposed may be respectively set to 60 μm or more.

In addition, a distance N from the upper surface of the magnetic body 10 to a portion of the first end surface thereof to which the first internal electrode 41 is exposed may be set to 100 μm or more, and a distance Q from the lower surface of the magnetic body 10 to a portion of the second end surface thereof to which the second internal electrode 42 is exposed may be set to 150 μm or more.

Figure 5:
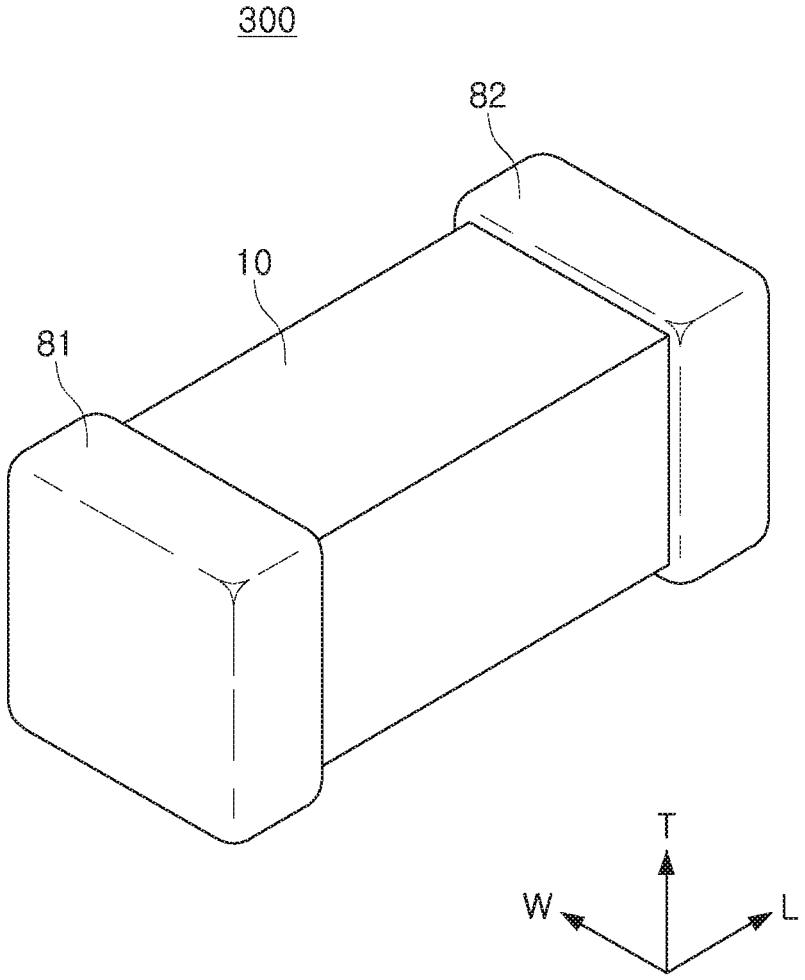
FIG. 5 is a perspective view of an inductor according to another embodiment of the present inventive concept.

FIG. 5 is a perspective view of an inductor 300 according to another embodiment of the present inventive concept.

Referring to FIG. 5, an inductor 300 according to an exemplary embodiment of the present inventive concept may further include first and second external electrodes 81 and 82 disposed on the first and second end surfaces of the magnetic body 10 to be connected to the first and second internal electrodes 41 and 42, respectively.

Hereinafter, respective components configuring the inductor 100 according to the exemplary embodiment of the present inventive concept will be described.

A material of the magnetic body 10 is not limited, as long as the material may form the exterior of the inductor 100 and exhibit magnetic properties. For example, the magnetic body 10 may be formed by providing a ferrite material or magnetic metal powder.

The ferrite material maybe a ferrite material commonly known in the art such as an Mn—Zn based ferrite, an Ni—Zn based ferrite, an Ni—Zn—Cu based ferrite, an Mn—Mg based ferrite, a Ba based ferrite, an Li based ferrite, or the like.

The magnetic metal powder may contain at least one selected from the group consisting of Fe, Si, Cr, Al, and Ni. For example, the magnetic metal powder may contain Fe—Si—B—Cr based amorphous metal particles, but is not limited thereto.

The magnetic metal powder may have a particle diameter of 0.1 μm to 30 μm and may be included in a form in which magnetic metal powder particles are dispersed in a thermoplastic resin such as an epoxy resin, polyimide, or the like.

The internal electrodes 41 and 42 disposed within the magnetic body 10 may be formed as spiral shaped coils.

The first internal electrode 41 having a coil shape may be formed on a first surface of the substrate 30 disposed within the magnetic body 10, and the second internal electrode having a coil shape may be formed on a second surface opposing the first surface of the substrate 30. The first and second internal electrodes 41 and 42 may be electrically connected to 10 each other through vias (not shown) formed in the substrate 30. The first and second internal electrodes 41 and 42 may be formed by an electroplating method.

The internal electrodes and vias (not shown) may contain a metal having excellent electrical conductivity, such as silver (Ag), palladium (Pd), aluminum (Al), nickel (Ni), titanium (Ti), gold (Au), copper (Cu), platinum (Pt), or alloys thereof.

The internal electrodes 41 and 42 may be coated with an insulating layer 50. The insulating layer 50 may be formed by an exposure or development process such as screen printing or photoresist (PR), or a spray coating process, commonly known in the art.

The insulating layer 50 may contain one or more materials selected from the group of epoxy, polyimide, and a liquid crystalline polymer (LCP), but is not limited thereto. The internal electrodes 41 and 42 may be coated with the insulating layer 50 and may not be in direct contact with a magnetic material forming the magnetic body 10.

The substrate 30 may be formed as, for example, a polypropylene glycol (PPG) substrate, a ferrite substrate, a metallic soft-magnetic material, or the like. A through hole may be formed to penetrate through a central portion of the substrate 30 and may be filled with a magnetic material to form a core part 55. In accordance with the formation of the core part 55 filled with a magnetic material, inductance Ls may be improved.

One end portion of the first internal electrode 41 formed on one surface of the substrate 30 may be exposed to one end surface of the magnetic body 10 in the length direction (L), and one end portion of the second internal electrode 42 formed on the other surface of the substrate 30 may be exposed to the other end surface of the magnetic body 10 in the length direction (L).

The internal electrodes 41 and 42 exposed to the both end surfaces of the magnetic body 10 in the length direction (L)

may be connected to the first and second external electrodes 81 and 82 to be electrically connected thereto.

The first and second external electrodes 81 and 82 may contain a metal having excellent electrical conductivity, such as nickel (Ni), copper (Cu), tin (Sn), silver (Ag), or the like, alone or in combination.

EXAMPLES

Tables 1 and 2 show comparative results obtained by observing process defects in inductors (Inventive Examples) according to an exemplary embodiment of the present inventive concept and in inductors (Comparative Examples) not in compliance with the exemplary embodiment of the present inventive concept, and measuring capacity degrees of the inductors. Table 1 was obtained by observing the occurrence of process defects depending on a distance from an upper surface of a magnetic body to a substrate and a distance from the upper surface of the magnetic body to an internal electrode. Table 2 was obtained by observing the occurrence of process defects depending on a distance from a lower surface of the magnetic body to the substrate and a distance from the lower surface of the magnetic body to an internal electrode.

In Tables 1 and 2, inductors each including a magnetic body having a thickness of 0.6 mm were used in the Inventive Examples and the Comparative Examples. In the examples of Table 1, a distance from the lower surface of the magnetic body to the internal electrode exposed to one end surface of the magnetic body was set to 150 μm or more. In the examples of Table 2, a distance from the upper surface of the magnetic body to the internal electrode exposed to one end surface of the magnetic body was set to 100 μm or more.

In Tables 1 and 2, the Inventive Examples were manufactured in such a manner that the substrate thereof was inclined, and distances from the upper and lower surfaces of the magnetic body to the substrate exposed to end surfaces of the magnetic body were set to 60 μm or more.

In Table 1, Comparative Example 1 was manufactured by not inclining the substrate, while Comparative Examples 2 to 9 were manufactured by inclining the substrate. In Table 2, Comparative Example 10 was manufactured by not inclining the substrate, while Comparative Examples 11 to 18 were manufactured by inclining the substrate.

The occurrence of process defects was confirmed by cutting the inductors according to the inventive and comparative examples to observe the occurrence of cracks, delamination, edge tearing, and the like, through scanning electron microscope (SEM) measurement.

TABLE 1

| | Inclination of Substrate | Distance from Upper Surface to Substrate (pm) | Distance from Upper Surface to Internal Electrode (pm) | Process Defects |
|---|---|---|---|---|
| Comparative Example 1 | Absent | | | Occurred |
| Comparative Example 2 | Present | 20 | 80 | Occurred |
| Comparative Example 3 | Present | 20 | 100 | Occurred |
| Comparative Example 4 | Present | 20 | 130 | Occurred |
| Comparative Example 5 | Present | 40 | 80 | Occurred |
| Comparative Example 6 | Present | 40 | 100 | Occurred |
| Comparative Example 7 | Present | 40 | 130 | Occurred |
| Comparative Example 8 | Present | 60 | 80 | Occurred |
| Inventive Example 1 | Present | 60 | 100 | Not Occurred |
| Inventive Example 2 | Present | 80 | 130 | Not Occurred |
| Comparative Example 9 | Present | 80 | 80 | Occurred |
| Inventive Example 3 | Present | 80 | 100 | Not Occurred |
| Inventive Example 4 | Present | 80 | 130 | Not Occurred |

TABLE 2

| | Inclination of Substrate | Distance from Lower Surface to Substrate (pm) | Distance from Lower Surface to Internal Electrode (pm) | Process Defects |
|---|---|---|---|---|
| Comparative Example 10 | Absent | | | Occurred |
| Comparative Example 11 | Present | 20 | 130 | Occurred |
| Comparative Example 12 | Present | 20 | 150 | Occurred |
| Comparative Example 13 | Present | 20 | 170 | Occurred |
| Comparative Example 14 | Present | 40 | 130 | Occurred |
| Comparative Example 15 | Present | 40 | 150 | Occurred |
| Comparative Example 16 | Present | 40 | 170 | Occurred |
| Comparative Example 17 | Present | 60 | 130 | Occurred |
| Inventive Example 5 | Present | 60 | 150 | Not Occurred |
| Inventive Example 6 | Present | 80 | 170 | Not Occurred |
| Comparative Example 18 | Present | 80 | 130 | Occurred |
| Inventive Example 7 | Present | 80 | 150 | Not Occurred |
| Inventive Example 8 | Present | 80 | 170 | Not Occurred |

As shown in Table 1, process defects did not occur when the substrate was inclined, the distance from the upper surface of the magnetic body to the substrate was 60 μm or more, and the distance from the upper surface of the magnetic body to the internal electrode was 100 μm or more.

As shown in Table 2, process defects did not occur when the substrate was inclined, the distance from the lower surface of the magnetic body to the substrate was 60 μm or more, and the distance from the lower surface of the magnetic body to the internal electrode was 150 μm or more.

As set forth above, according to embodiments of the present inventive concept, an inductor having high capacity characteristics and allowing for reliability improvements in a manufacturing process by preventing defects due to delamination, cracks, and the like, may be provided.

While the present inventive concept has been shown and described in connection with the embodiments, it will be apparent to those skilled in the art that modifications and variations can be made without departing from the spirit and scope of the invention as defined by the appended claims.

What is claimed is:

1. An inductor comprising:

a magnetic body including a magnetic substance;

a substrate disposed within the magnetic body; and a coil disposed on a surface of the substrate in a stacking direction, wherein the substrate has first and second portions on which respective portions of an outermost turn of the coil is disposed and a third portion on which an innermost turn of the coil is disposed, a lower surface of the magnetic body overlaps the surface of the substrate in the stacking direction, the first portion is nearer from the lower surface of the magnetic body than the third portion, and the third portion is nearer from the lower surface of the magnetic body than the second portion.

2. The inductor of claim 1, wherein a first distance from an upper surface of a portion of the outermost turn of the coil disposed on the first portion to an upper surface of the magnetic body is different from a second distance from an upper surface of a portion of the outermost turn of the coil disposed on the second portion to the upper surface of the magnetic body.

3. The inductor of claim 2, wherein the first distance is greater than the second distance.

4. The inductor of claim 2, wherein a third distance from an upper surface of a portion of the innermost turn of the coil disposed on the third portion to the upper surface of the magnetic body is different from the first and second distances.

5. The inductor of claim 4, wherein the first distance is greater than the second distance, and the third distance is greater than the second distance.

6. The inductor of claim 1, wherein at least a portion of an upper surface of the coil is disposed on an incline with respect to at least one of opposing upper and lower surfaces of the magnetic body.

7. The inductor of claim 1, wherein a distance from an upper surface to the lower surface of the magnetic body is 0.8 mm or less.

* * * * *